US008766115B2

(12) United States Patent
Kristen

(10) Patent No.: US 8,766,115 B2
(45) Date of Patent: Jul. 1, 2014

(54) PUSHBUTTON CONTROLLER WITH CUTOFF SWITCH

(75) Inventor: Martin Kristen, Gelsenkirchen (DE)

(73) Assignee: Stanzwerk Wetter Sichelschmidt GmbH & Co. KG, Wetter (DE)

( * ) Notice: Subject to any disclaimer, the term of this patent is extended or adjusted under 35 U.S.C. 154(b) by 82 days.

(21) Appl. No.: 13/495,088

(22) Filed: Jun. 13, 2012

(65) Prior Publication Data

US 2013/0292236 A1 Nov. 7, 2013

(30) Foreign Application Priority Data

May 3, 2012 (DE) ..... 10 2012 009 166

(51) Int. Cl.
*H01H 9/26* (2006.01)

(52) U.S. Cl.
USPC ..... 200/5 A

(58) Field of Classification Search
USPC ..... 200/5 A, 304; 297/330
See application file for complete search history.

(56) References Cited

U.S. PATENT DOCUMENTS

| | | | | |
|---|---|---|---|---|
| 8,201,877 | B2 * | 6/2012 | Hsieh et al. | 297/89 |
| 2009/0090609 | A1 * | 4/2009 | Rowntree | 200/5 A |
| 2010/0323592 | A1 * | 12/2010 | Nemetz et al. | 451/353 |
| 2012/0160650 | A1 * | 6/2012 | Yang et al. | 200/5 A |

* cited by examiner

*Primary Examiner* — Vanessa Girardi
(74) *Attorney, Agent, or Firm* — Andrew Wilford

(57) ABSTRACT

A controller for operating an electric drive of a reclining chair or couch has a housing mountable on the chair or couch, a pair of control switches on the housing and connectable to the drive motor to operate same, a locking or cutoff switch on the housing, and a supply cable extending from the housing to an electricity source capable of powering and forming with the electric drive. The control switches, and cutoff switch form a circuit interruptible by the cutoff switch so that in the off position of the cutoff switch the control switches are unable to operate the drive and in the on position of the cutoff switch the control switches can operate the drive. A cover shiftable on the cover between a first position setting the cutoff switch in the on position and a second position can set the cutoff switch in the off position.

8 Claims, 1 Drawing Sheet

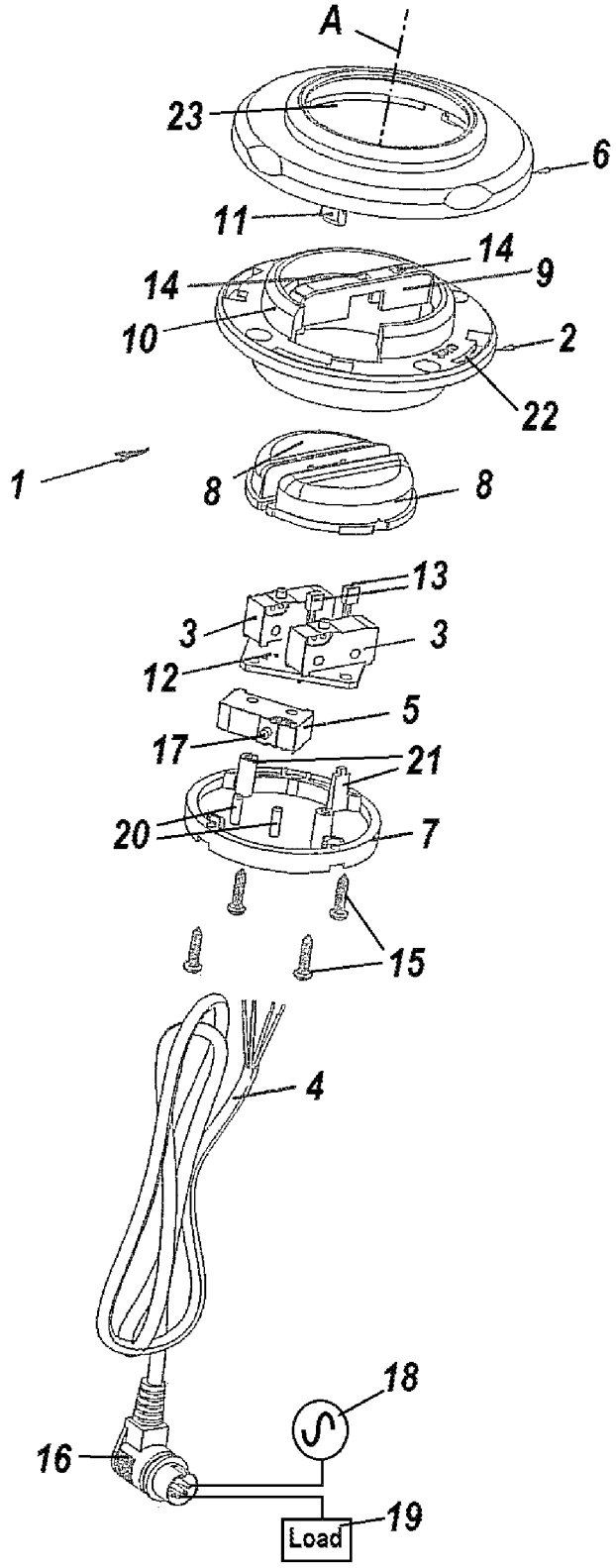
A
23
6
11
14
14
9
10
2
22
1
8
8
13
3
3
12
5
17
21
20
7
15
4
18
16
19
Load

PUSHBUTTON CONTROLLER WITH CUTOFF SWITCH

FIELD OF THE INVENTION

The present invention relates to a controller. More particularly this invention concerns a built-in manual controller for operating an electric drive motor of a recliner.

BACKGROUND OF THE INVENTION

A typical recliner is a chair or couch that can move from a neutral or up position into a reclined or comfort position and back into the neutral position. It typically has a built-in manual controller having a housing in which various switches for actuating the electric drive or drives of the recliner are held. These switches are operated by an actuator element and adjust the recliner from the neutral position into the comfort position and back into the neutral position. The built-in controller having a lock for blocking undesired activation, and is connected or connectable to the electric drives and to a power source via a current-conducting cable.

Using these types of built-in controllers known in the prior art, a recliner adjustable by an electric motor may be adjusted by the user from a neutral position into a comfort position and then back into the neutral position in a particularly convenient manner. For this purpose, the user only has to appropriately activate the built-in controller, resulting in the adjustment by electric motor, typically moving the back between an erect up position to a more horizontal down position.

To prevent unintentional readjustment of the recliner, built-in controllers are known in the prior art that can prevent the position-control switches from functioning. For this purpose it is known, for example, to provide the built-in controller with an additional key-operated cutoff switch connected in series with the control switches, for example, so that the built-in controller may be operated only by use of the key-operated switch. The built-in controller does not function when blocked by the key-operated switch.

In another built-in controller known in the prior art, the locking and unlocking occurs by means of a switching contact in a hole or recess, for example, and that may be activated only by using a thin, pointed object in order to enable or block the built-in controller.

OBJECTS OF THE INVENTION

It is therefore an object of the present invention to provide an improved built-in manual controller for the electric mot or of a recliner.

Another object is the provision of such an improved built-in manual controller for the electric motor of a recliner that overcomes the above-given disadvantages, in particular that is quickly and easily locked and unlocked by the user without additional objects such a key, for example, and is economically and easily manufactured and has a long service life.

SUMMARY OF THE INVENTION

A controller for operating an electric drive of a reclining chair or couch has according to the invention a housing mountable on the chair or couch, a pair of control switches on the housing and connectable to the drive motor to operate same, a locking or cutoff switch on the housing movable between an off position and an on position, and a supply cable extending from the housing and connectable to a electricity source capable of powering and forming with the electric drive. The control switches, and cutoff switch form a circuit interruptible by the cutoff switch so that in the off position of the cutoff switch the control switches are unable to operate the drive and in the on position of the cutoff switch the control switches can operate the drive. A cover shiftable on the cover between a first position setting the cutoff switch in the on position and a second position can set the cutoff switch in the off position.

Thus, in a built-in controller according to the invention, the switch or switches for controlling the electric motor-driven adjustment of the recliner are blocked or enabled by a cutoff switch operable by twisting the cover of the housing. After adjusting the recliner in the desired position, a user may lock the cutoff switch by simply twisting the cover mounted on the housing in order to prevent further, undesired adjustment of the recliner. The actual activation of the switches for actuating the electric drives is thus interrupted, and is not enabled again until the switching element is activated once more by twisting the cover. In this type of built-in controller according to the invention, no additional means such as a key or an actuator element, for example, has to be kept on hand by the user, since all parts for locking the electric motor-driven adjustment of the recliner are situated on or inside the built-in controller. In addition, intuitive operation with only one hand is possible in a quick and simple manner, so that, for example, use by elderly or physically limited persons is also possible in a quick and simple manner.

Furthermore, this type of built-in controller is economically and easily manufactured, and has a long service life. This is in part because the switches for actuating the electric drives of the recliner and/or the cutoff switches are microswitches. The use of microswitches for the control switches and/or the cutoff switch allows a particularly compact design of the built-in controller, so that it has only very small dimensions, also in the assembled state.

In addition, according to the invention the cover is rotatable with respect to the housing, from a first position corresponding to the on position of the cutoff switch into a second position corresponding to the off position of the cutoff switch and back.

The switch(es) for actuating the electric drives may be operated by slightly twisting the cover with respect to the housing, for example may be enabled by turning clockwise and may be locked by turning counterclockwise.

In addition, the housing of the built-in controller has a base on which an installation plate is mounted, and the two switches for actuating the electric drives of the recliner are provided on the upper outer face of this plate, while the cutoff switch is sandwiched between this installation plate and the base. Each of the two control switches is covered and operable by a respective push button for actuating the electric drive in respective directions. The housing and the base are of circular shape. A web on the housing on the opposite side from the base in the assembled state is between the two push buttons. The web, the two push buttons, and a collar formed on the housing pass through a central hole or opening of the cover, and in addition a switch finger as a switch actuator is situated or formed on the cover and engages through the housing interior with the cutoff switch.

With such an arrangement of the control switches for actuating the electric drive and the cutoff switch for interrupting or enabling the switches for actuating the electric drive, an extremely compact design of the built-in controller which occupies only a small volume is achieved. In addition, all electrical parts are located inside a housing which effectively protects them from external influences, for example liquids or the like which accidentally flow over the parts.

This type of built-in controller may be situated, for example, in the arm rest or in an adjacent part of the recliner near the arm rest, so that the user has access to the switch in any position of the recliner. Alternatively, the built-in controller may also be connected to the recliner by means of a cable for free positioning by the user.

For particularly simple operation of the electric motor-driven adjustment of the recliner from the neutral position into the comfort position and back into the neutral position, it may particularly preferably be provided that the switches for actuating the electric drive of the recliner are situated on the top side on a printed circuit board forming an installation board to which the contacts of all the switches are soldered, and the cutoff switch which in a first position enables an electric circuit for controlling the electric drive of the recliner, and which in a second position interrupts this electric circuit, is situated on the bottom side between the printed circuit board and the base, on or near the printed circuit board, the printed circuit board being indirectly connected to the base.

By means of switches arranged in this way, activating the first switch adjusts the recliner from the neutral position into the comfort position, for example, and activating the second switch adjusts the recliner from the comfort position back into the neutral position. The individual control switches are activated by exerting pressure on the switches, for example by a finger of the user. As soon as the user no longer exerts pressure on the switch, the recliner remains in the current position. By activating the cutoff switch, the user is then able to disconnect the control switches for actuating the electric drive, and thus ensure that the recliner is not inadvertently is moved from this position.

To quickly and easily show the user the particular switching state the cutoff switch is in, it may particularly preferably be provided that one or more lighting means, in particular LED's, is/are situated on the printed circuit board, each of which shines through a respective window in the web of the housing, and is powered from the printed circuit board to signals the particular switching state.

With the aid of pilot lights arranged in this way, the user may be signaled at any time as to whether the cutoff switch is interrupting or enabling the switches for the electric motor-driven adjustment of the recliner. Thus, the actual state of the cutoff switch is quickly and easily apparent to the user at all times. The pilot lights are of different colors, one color being associated with each switching state of the cutoff switch.

Thus, for example, a lamp or LED that lights up red may be used for signaling the interruption of the switches for the electric motor-driven adjustment, and a lamp or LED that lights up green, for example, may be used for signaling the enabling of the switches for the electric motor-driven adjustment by the cutoff switch. Thus, by signaling of the appropriate color, the user is quickly and easily notified whether the built-in controller is in the locked position of the cutoff switch or in the enabled position of the cutoff switch.

It may also particularly preferably be provided that the base is releasably or permanently connected to the housing, for example by screwing, riveting, or clipping. Lastly, it may particularly preferably be provided that the cover is fastened to the housing by a bayonet coupling or a snap lock. By providing a bayonet lock or a snap lock on the housing, the cover may be fastened to the housing, and at the same time, twisting may be performed for locking or unlocking the cutoff switch.

BRIEF DESCRIPTION OF THE DRAWING

The above and other objects, features, and advantages will become more readily apparent from the following description, reference being made to the accompanying drawing whose sole FIGURE is a partly diagrammatic exploded view of the controller according to the invention.

SPECIFIC DESCRIPTION OF THE INVENTION

As seen in the drawing a built-in controller 1 serves for controlling the electric motor 19 of a reclining chair or sofa. Such a recliner is adjustable by the electric motor 19 from a neutral position in which a back part, for example, is approximately perpendicular, into a comfort position in which the back part is pivoted to the rear into a more horizontal position, and back into the neutral position. The built-in controller 1 has a housing 2 in which various switches 3 for actuating the electric drive 19 of the recliner are situated. The built-in controller 1 has a locking means for blocking undesired activation, and is connectable to the electric drive 19 and/or to a power source 18 via a current-conducting cable 4 carrying a four-prong plug 16.

According to the invention, the locking means of the built-in controller 1 is formed by a locking or cutoff switch 5. The cutoff switch 5 is inside the housing 2, and is operable by a cover 6 mounted on the housing 2 and having a switch actuator 11 on its bottom face. In a first position the cutoff switch 5 closes an electric circuit for controlling the electric drive 19 of the recliner, and in a second position interrupts this electric circuit. Undesired actuation of the electric drive 19 of the recliner is quickly and easily prevented by the user by activating the cutoff switch 5 via the cover 6. As soon as the user has got the recliner in the desired position by activating the switches 3, he/she may activate the cutoff switch 5 to interrupt the electric circuit for the switches 3 and thus prevent further adjustment of the recliner. If at a later time the user wishes to readjust the recliner into another position by the electric motor 19, it is only necessary to first move the cutoff switch 5 via the pivotal cover 6 into the enabled position, after which the electric drive 19 may then be activated in a manner known as such by the switches 3.

With this built-in controller 1, which is economically and easily manufacturable and has a long service life, the user is provided with an easy-to-operate interruption option for the switches 3 for actuating the electric drive 19 of the recliner. This type of built-in controller 1 is particularly easy for the user to operate without assistance from other objects such as a key, for example.

As is apparent from the drawing, the switches 3 for actuating the electric drive 19 of the recliner and the cutoff switch 5 are microswitches. In the illustrated embodiment, the cover 6 is twistable with respect to the housing 2 about a center axis A of the assembly, from a switched position into an open position and back into the closed position of the cutoff switch 5. A user is thus able to set the cutoff switch 5 coupled to the cover 6 particularly easily by twisting the cover 6 into an interrupting position preventing power from getting from the source 13 to the switches 3 or a connecting position connecting the switches 3 to the power supply 18. This type of operation of the cutoff switch 5 is very easily manageable and intuitively learnable by practically any user.

In the illustrated embodiment, the housing 2 of the built-in controller 1 has a base 7. The base 7 is provided with an installation disk or plate 12 whose axial inner face carries the cutoff switch 5 so it is between the installation plate 12 and the base 7. The two switches 3 for actuating the electric drive 19 of the recliner are mounted on the top side or axial outer face of the installation plate 12. These switches 3, which actuate the electric drive 19 of the recliner in respective directions are each covered by a respective axially shiftable push button 8, and are easily activatable by pressing, for example by the finger of a user. The housing 2 and the base 7 are approximately circular. A planar web 9 is formed on the housing 2 and projects axially away from the base 7, and in the assembled state is situated between the two push buttons 8. The web 9, the two push buttons 8, and a semicylindrical axially extending collar 10 formed on the housing 2 pass through a central hole or opening 23 in the cover 6. In addition, an axially inwardly projecting switch finger forming the switch actuator 11 is formed on the cover 6. The switch finger 11 engages through the housing 2 so it can actuate the cutoff switch 5, which is also a microswitch. In the illustrated embodiment, the switches 3 for actuating the electric drive 19 of the recliner are situated on the top side or outer face of a printed circuit board forming the installation plate 12.

In a first position, the cutoff switch 5 supplies power from the source 18 to the switches 3 to form an electric circuit for powering the electric drive 19 of the recliner, and in a second position interrupts this electric circuit. The cutoff switch 5 on the back or inner face of the printed circuit board 12, between the printed circuit board 12 and the base 7. An actuating button or pin 17 of the switch 5 projects radially to the side, and is activatable by the switch finger 11. Alternatively, the cutoff switch 5 may be situated on the base 7, under the printed circuit board 12. In the illustrated embodiment, the printed circuit board 12 is indirectly connected to the base 7 via mounting pins 20 and 21.

Two LEDs 13 are situated on the printed circuit board 12 for quickly and easily visually signaling the particular switching state of the cutoff switch 5. Each LED 13 shines through a respective window 14 in the web 9 of the housing 2 in order to notify the user of the particular switching state. The LEDs 13 are powered from the printed circuit board 12. In the illustrated embodiment, the LEDs 13 have different colors, one color being associated with each switching state of the cutoff switch 5. In the illustrated embodiment, a red LED is provided for the position of the cutoff switch 5 in which the electric circuit for controlling the electric drive 19 of the recliner is interrupted, and a green LED is provided for signaling the enabled position of the cutoff switch 5 in which the switches 3 of the electric drive 19 of the recliner are active.

Alternatively, and not shown in the illustrated embodiment, a single LED 13, for example, may be provided which signals the particular switching state by lighting up or not lighting up.

In the illustrated embodiment, the base 7 is detachably connected to the housing 2 by screws 15. Alternatively, the base 7 may be connected to the housing 2 by riveting or clipping. In the illustrated embodiment, the cover 6 is fastened to the housing 2 by a snap lock, and in an alternative illustrated embodiment may be connected by means of bayonet formations 22.

The invention is not limited to the illustrated embodiment, and may be varied in many ways within the scope of the disclosure.

All individual and combined features disclosed in the description and/or drawing are considered to be essential to the invention.

I claim:

1. A controller for operating an electric drive motor of a reclining chair or couch, the controller comprising:

a housing mountable on the chair or couch;

a pair of control switches on the housing and connectable to the drive motor to operate same;

a cutoff switch on the housing movable between an off position and an on position;

a supply cable extending from the housing and connectable to a electricity source capable of powering and forming with the electric drive, the control switches, and cutoff switch a circuit interruptible by the cutoff switch, whereby in the off position of the cutoff switch the control switches are unable to operate the drive and in the on position of the cutoff switch the control switches can operate the drive;

a cover shiftable on the housing between a first position setting the cutoff switch in the on position and a second position setting the cutoff switch in the off position;

an installation plate between the cover and the housing and mounted on the housing, the control switches being between the installation plate and the cover and the cutoff switch being between the installation plate and the housing;

a base offset axially inward from the plate and having bayonet formations securing the base to the housing with the installation plate s sandwiched between the base and housing; and respective push buttons axially independently shiftable in the cover and operatively engaging the control switches.

2. The controller defined in claim 1, wherein at least one of the switches is a microswitch.

3. The controller defined in claim 1, wherein the cover is provided with an axially directed actuating finger engageable with the cutoff switch for shift same between the on and off positions.

4. The controller defined in claim 1 wherein the installation plate is a circuit board fixed on but spaced from the housing and carrying all the switches.

5. The controller defined in claim 1, wherein the cover is generally circularly annular and has a central hole and the housing has a diametral web generally bisecting the hole, the pushbuttons extending through the hole to respective sides of the web.

6. The controller defined in claim 5, further comprising:

at least one light-emitting diode carried on the circuit board, visible through the cover, and indicating whether the cutoff switch is in the on or off position.

7. The controller defined in claim 6 wherein there are two such diodes each indicating a respective position of the cutoff switch.

8. The controller defined in claim 7 wherein the diodes are of different colors.

* * * * *